United States Patent [19]

Tarrano et al.

[11] Patent Number: 4,945,735

[45] Date of Patent: Aug. 7, 1990

[54] WASHING MACHINE WITH IMPROVED PUMP CONTROL DEVICE FOR CLOSING A VALVE

[75] Inventors: Vincenzo Tarrano; Luciano Guarino, both of Naples, Italy

[73] Assignee: Whirlpool International B.V., Eindhoven, Netherlands

[21] Appl. No.: 364,335

[22] Filed: Jun. 9, 1989

[30] Foreign Application Priority Data

Jun. 22, 1988 [IT] Italy ..... 21069A/88

[51] Int. Cl.[5] ..... D06F 33/02; D06F 39/08

[52] U.S. Cl. ..... 68/12 R; 68/208

[58] Field of Search ..... 68/12 R, 208; 134/57 D, 134/155, 186; 137/571

[56] References Cited

U.S. PATENT DOCUMENTS 3,285,038 11/1966 Wolverton ..... 68/208 X 4,821,537 4/1989 Zinkann et al. ..... 68/208

FOREIGN PATENT DOCUMENTS 3602920 8/1987 Fed. Rep. of Germany ..... 68/208

2099462A 12/1982 United Kingdom .

*Primary Examiner*—Philip R. Coe

*Attorney, Agent, or Firm*—Ernestine C. Bartlett

[57] ABSTRACT

Washing machine is provided with improved pump control device for closing a valve, in particular a flap valve, for detergent economy, and control device suited for use in a washing machine.

A washing machine comprising a tub (104), a solenoid valve (3) for the water feed into the tub (104), a discharge pipe (103), a delivery pipe (107), a pump (101) and a valve preferably a flap type (102) for detergent economy located at the mouth of the discharge pipe (103) at the tub (104), the washing machine (100) comprising a control device (1) for pulse-operating the pump (101) to create a water head in the discharge pipe (103) which is able to close the valve (102), the device (1) comprising a resistor (2) the resistance of which varies directly as a function of its temperature and which is connected in parallel with the solenoid valve (3) and in series with the pump (101), the device (1) for pulse-operating the pump (101) further comprising means (14) which dissipate heat when traversed by current and which thermally coupled with the variable resistor (2), the means (14) maintaining the temperature of the resistor (2) relatively high so that its resistance remains high during the operating stages of the washing machine (100) subsequent to starting.

4 Claims, 1 Drawing Sheet

WASHING MACHINE WITH IMPROVED PUMP CONTROL DEVICE FOR CLOSING A VALVE

Washing machine with improved pump control device for closing a valve, in particular a flap valve, for detergent economy, and control device suited for use in a washing machine.

BACKGROUND OF THE INVENTION

The invention relates to a washing machine comprising a tub, a solenoid valve for the water feed to the tub, a discharge pipe, a delivery pipe, a pump and a valve preferably of flap type for detergent economy located at the mouth of the discharge pipe at the tub.

The invention further relates to a control device suited for use in a washing machine.

A method has been known for some time which on washing machine start-up enables the flap valve to be closed by the effect of a pressure exerted on said valve by a water head present in the discharge and delivery pipes. Closing this valve is known to prevent detergent passing partly into the discharge pipe and pump during its feed into the tub, with consequent wastage. There is therefore the need on washing machine start-up to create a water head in the discharge and delivery pipes which is sufficient to close the valve and keep it closed. Various control devices have already been designed and constructed for operating the jump pulse-wise to obtain the necessary head. In particular, these devices comprise the use of a resistor the resistance of which varies directly as a function of its temperature, namely a PTC, which has negligible electrical resistance at low temperature, but high resistance at high temperature, this high temperature being obtained by the passage of current through the PTC itself. One of such devices uses a PTC in parallel with a solenoid valve which is connected in series with a timer and pressure switch. On washing machine start-up this circuit acts by way of the PTC on the pump to operate it for a short time period (eg. 5–15 seconds) so that the pump feeds into the delivery pipe the water which has remained in the machine after the previous wash. As the PTC heats up on passage of current through it, its resistance becomes very high and the current then passes through the branch circuit in which the solenoid valve is connected, this then operating to feed water into the tub to a level determined by the pressure switch. This causes a voltage drop across the solenoid valve such that the voltage across the pump is finally too low to operate it. When pump operation ceases, the water present in the delivery pipe flows towards the tub, so closing the flap valve. The water head thus created acts on the valve to keep it closed.

Although this method has various advantages (the flap valve operation takes place in a practical manner and the circuit can be constructed very simply at low cost), it has a serious drawback in that whenever the washing machine is stopped during the wash stage, its subsequent restart takes place with the PTC cold (and therefore with low resistance), with the result that the current is able to pass through it and operate the pump so that the valve opens and the water and detergent present in the tub are discharged.

Various alternative forms of the aforesaid circuit have been devised, but these all retain the said circuit drawback.

SUMMARY OF THE INVENTION

An object of the present invention is therefore to provide a washing machine with a pump control device which although comprising a resistor of the type wherein the resistance varies directly with its temperature, does not have the drawbacks related to the use of such a resistor in devices of the known art.

This and further objects which will be apparent to the expert of the art are attained by a washing machine comprising a tub, a solenoid valve for the water feed to the tub, a discharge pipe, a delivery pipe, a pump and valve preferably of flap type for detergent economy located at the discharge pipe mouth at the tub, said washing machine comprising a control device for pulse-operating the pump to create a water head in the discharge pipe which is able to close said valve, said device comprising a resistor wherein the resistance is a function of its temperature and which is connected in parallel with the usual solenoid valve and in series with said pump, the device for pulse-operating the pump further comprising means which dissipate heat when traversed by current and which are thermally coupled with the variable resistor, said means maintaining the temperature of said resistor relatively high so that its resistance remains high during the operating stages of the washing machine subsequent to starting.

BRIEF DESCRIPTION OF THE DRAWING

The present invention will be more apparent from the accompanying drawing, which is provided by way of non-limiting example and in which.

DETAILED DESCRIPTION OF THE PREFERRED EMBODIMENTS

Figure 1:
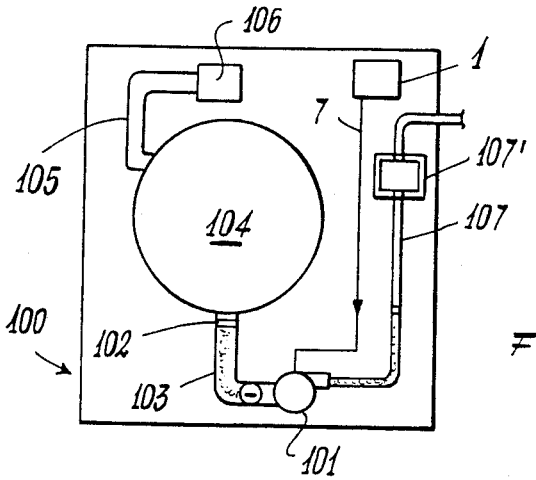
FIG. 1 represents a front sectional view of a washing machine according to the invention.
Figure 2:
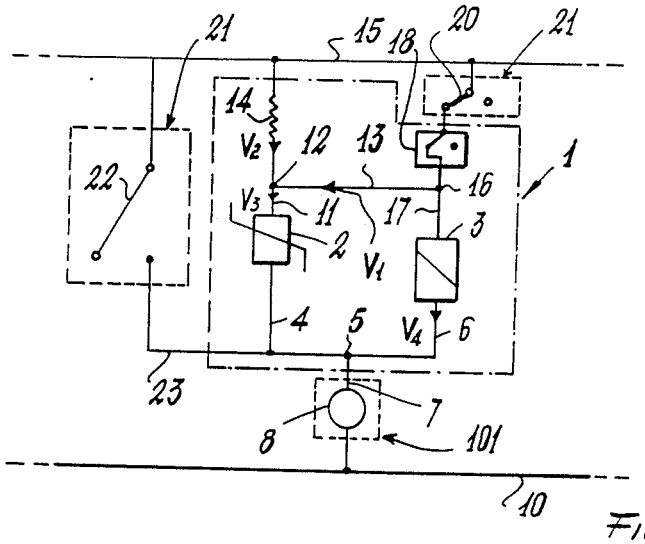
FIG. 2 is a simplified schematic representation of the circuit of a device connected into the washing machine of FIG. 1.

With reference to FIGS. 1 and 2, in a washing machine 100, a control device for a pump 101 for closing a known flap, ball or other valve 102 located at the mouth of a discharge pipe 103 of a tub 104 is indicated overall by the reference numeral 1 and comprises a resistor 2 the resistance of which varies with its temperature, known as a PTC, connected in parallel with a solenoid valve 3 which governs the water feed into the tub 104. A branch 4 extends from the PTC to a node 5 to which a branch 6 from the solenoid valve 3 is connected. A branch 7 extends from this node to the motor 8 of a discharge pump 101. This branch provides one voltage phase to said motor 8, the other phase being taken directly by the motor from a line 10.

The PTC is connected to a branch 11 extending from a node 12 to which a branch circuit 13 and a resistor 14 of determined resistance is connected. This resistor is also connected to a line 15 carrying a voltage phase opposite to that of said line 10. The circuit branch 13 is connected to a node 16 to which the solenoid valve 3 is connected by way of a branch 17.

A known pressure switch 18 is connected to said node 16 and to a switch 20 which is connected directly to the line 15. The switch 20 is operated by a conventional timer 21 provided for this purpose with a suitable control cam.

Said timer 21 also operates another switch 22 connected to the line 15 and, by way of a branch 23, to the node 5 and hence to the motor 8 of the pump 101. The timer 21, by closing the switch 22, bypasses the device 1 to enable the pump 101 to be operated directly during the normal operating stages of the washing machine 100.

It will now be assumed that the washing machine 100 is to be started. Before feeding the water and detergent into the tub 104, said detergent reaching the tub through a pipe 105 from a drawer 106, the flap valve or the like located at the mouth of the discharge pipe 103 at the tub 104 must be closed. This is done by feeding current to the device 1 by way of the switch 20. A current signal hence passes through the pressure switch 18 (the contact of which is closed as there is as yet insufficient water level in the tub 104).

In this assumed situation (washing machine not previously operating), the PTC 2 is "cold" and has practically negligible resistance compared with the resistance of the solenoid valve 3. The PTC therefore behaves practically in the manner of a short circuit. For this reason, the current signal $V_1$ originating from the line 15 by way of the pressure switch 18 passes through the branch 13 to reach the node 12, with no signal passing through the resistor 14 which has been short-circuited by the switches 18, 20. From the node 12 the signal $V_1$ reaches the PTC 2 and passes through it to reach the node 5 to provide one voltage phase at the motor 8 of the pump 101. The motor obtains its other voltage phase from the line 10 to thus operate so that the pump 101 feeds the water present in the discharge pipe 103 of the tub 104 and any water present in the tub itself into the delivery pipe 107 which suitably comprises an expansion chamber 107' positioned at a higher level than that which the water can reach in the tub 104 during washing.

With the passage of the current signal $V_1$ the PTC 2 heats up and consequently its electrical resistance increases. Thus, on attaining and exceeding a certain characteristic temperature, the electrical resistance of the PTC 2 becomes such as to no longer allow the passage of current sufficient to keep the pump 101 in operation, so that said pump 101 stops, however the solenoid valve 3 does not yet operate. This is because the voltage now present across the solenoid valve is insufficient to energize it.

Consequently after this stage of operation of the pump 101 the water from the delivery pipe 107 and from the expansion chamber 107' moves in the reverse direction to that imparted by the pump 101, to close the valve 102. By virtue of the water head now present in said pipes 107 and 103 the valve 102 remains closed. At a certain point, the PTC 2 attains a temperature such that its resistance rises to a very high level to interrupt the circuit branch in which the PTC is connected. From this moment the signal $V_1$ passes through the branch to the solenoid valve 3, which operates to feed water into the tub 104 to the predetermined level controlled by the pressure switch 18.

As the passage of the signal $V_1$ through the solenoid valve 3 causes a voltage drop across the solenoid valve itself, the signal $V_1$ reaching the node 5 through the branch 6 from said pressure switch 3 is too small to provide a voltage across the motor 8 of the pump 101 which is sufficient to operate the pump 101.

When the water has reached the required level in the tub 104, the switch 20 of the timer 21 opens to interrupt current flow to the solenoid valve 3. However, at this point a current signal $V_2$ passes from the line 15 to the resistor 14 with consequent heating of the resistor 14. As the PTC 2 is in contact with said resistor 14, the heat dissipated by this latter keeps the temperature of said PTC and thus its electrical resistance relatively high. Thus the current signal Vz does not pass through said PTC and no operation of the pump 101 is possible. The signal $V_2$ passes instead through the branch 13 to the solenoid valve 3. However, as the voltage across the solenoid valve 3 is relatively low (obtained by the voltage drop across the suitably sized resistor 14), it is unable to operate the solenoid valve 3 which thus remains inactive.

As a result of the aforegoing, even if during the wash stage the user switches off the washing machine and restarts it after a short time, the pump 101 does not operate. This is because the resistor 14, through which current passes, has a temperature such as to keep the PTC 2 hot and prevent current passing through it to operate the pump 101.

After the wash stage the timer 1 opens the contact 20.

Figure 3:
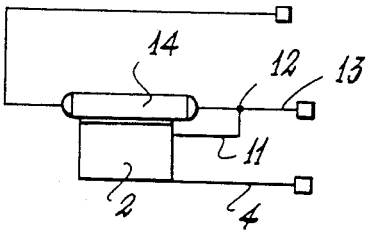
FIG. 3 is a detailed view of one example of part of the circuit of FIG. 2.

FIG. 3 shows a practical example of the connection between the resistor 14 and the PTC 2 which have been described heretofore with reference to FIG. 2. In FIG. 3, parts corresponding to those of FIG. 2 are indicated with the same reference numerals. A washing machine 100 constructed in accordance with the present invention prevents loss of detergent when the washing machine is stopped (for example to put further articles into the tub for washing) and then restarted, as happens in washing machines of the state of the art. The pump control device of said washing machine is moreover of easy construction and low cost.

We claim:

1. A washing machine comprising a tub (104), a solenoid valve (3) for the water feed into the tub (104), a discharge pipe (103) having a mouth through which it is connecting to the tub, a delivery pipe (107) for delivering water to the solenoid valve, a pump (101) situated between and connected to the discharge pipe and the delivery pipe and a valve (102) for detergent economy located at the mouth of the discharge pipe (103) at the tub (104), said washing machine (100) comprising a control device (1) for pulse-operating the pump (101) to create a water head in the discharge pipe (103) which is effective to close said valve (102), said device (1) comprising a resistor (2) the resistance of which varies directly as a function of its temperature and which is connected in parallel with the solenoid valve (3) and in series with said pump (101), the device (1) for pulse-operating the pump (101) further comprising means (14) which dissipates heat when traversed by current and which is thermally coupled with the variable resistor (2), said means (14) maintaining the temperature of said resistor (2) relatively high so that its resistance remains high during the operating stages of the washing machine (100) subsequent to starting.

2. A washing machine as claimed in claim 1, wherein the heat dissipating means is a resistor (14).

3. A washing machine as claimed in claim 2, wherein the resistor (14) in contact with the variable resistor (2) is connected to a feed line (15) and in parallel with a switch (20) of a timer (21), said switch (20) being in series with a pressure switch (18).

4. A washing machine as claimed in claim 3, wherein the resistor (14) is connected to a node (12) to which the variable resistor (2) is connected by a branch (11), a branch(13) extending from said node (12) and terminating in a node (16) to which the pressure switch (18) and solenoid valve (3) are connected.

* * * * *